US006253562B1

(12) United States Patent
Bujak, Jr.

(10) Patent No.: US 6,253,562 B1
(45) Date of Patent: Jul. 3, 2001

(54) REFRIGERANT SUBCOOLER FOR VAPOR COMPRESSION REFRIGERATION SYSTEM

(75) Inventor: Walter E. Bujak, Jr., Suffield, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/472,613

(22) Filed: Dec. 27, 1999

(51) Int. Cl.[7] ..... F25B 41/04

(52) U.S. Cl. ..... 62/210; 62/506; 62/219; 62/206

(58) Field of Search ..... 62/196.1, 196.2, 62/196.3, 196.4, 506, 509, 208, 209, 210, 211, 212, 219, 468, 469, 470, 504, 203, 204, 205, 206

(56) References Cited

U.S. PATENT DOCUMENTS 4,171,623 * 10/1979 Lavigne, Jr. et al. ..... 62/219 X
4,437,322 * 3/1984 Ertinger ..... 62/504
5,570,583 * 11/1996 Boehde et al. ..... 62/470 X
5,613,368 * 3/1997 Marohl et al. ..... 62/468 X

* cited by examiner

*Primary Examiner*—Harry B. Tanner

(57) ABSTRACT

A subcooling unit within a vapor compression refrigerant system contains a controller for controlling the rate of flow of refrigerant into the chamber of the subcooling unit. The controller receives a sensed temperature of the fluid entering a condensing unit within the chamber of the subcooling unit and computes a condensing pressure setpoint for the refrigerant flowing into the chamber of the subcooling unit. The controller is operative to compare the pressure in the subcooling chamber with the condensing pressure setpoint so as to determine whether to possibly increase or decrease the rate of flow of the refrigerant into the chamber of the subcooling unit.

14 Claims, 2 Drawing Sheets

REFRIGERANT SUBCOOLER FOR VAPOR COMPRESSION REFRIGERATION SYSTEM

BACKGROUND OF THE INVENTION

This invention relates to vapor compression refrigeration systems and, more particularly, to a subcooler within such systems for subcooling refrigerant.

Subcoolers have heretofore been used in vapor compression refrigeration systems to subcool refrigerant flowing from the condenser to the evaporator. Hot liquid refrigerant from the condenser typically passes through one or more orifices or nozzles located in the subcooler. These orifices or nozzles define a pressure drop between the condenser and the chamber of the subcooler. This pressure drop causes a portion of the liquid refrigerant to flash to vapor as it leaves the orifices or nozzles. The vapor refrigerant absorbs heat from the remaining liquid refrigerant passing into the chamber of the subcooler. The subcooler chamber may also include a condensing coil which circulates fluid having a temperature that recondenses the flashed vapor refrigerant. The recondensed refrigerant and the subcooled refrigerant exit the subcooler chamber for circulation through the evaporator. The above vapor compressor system is disclosed in U.S. Pat. No. 4,207,749 issuing to William J. Lavigne, Jr., on Jun. 17, 1980.

The orifices or nozzles of the aforementioned system are sized for a specific refrigerant flow that will create a particular pressure drop from the condenser into the subcooler chamber. The refrigerant flow is usually assumed to be the flow occurring at a full load condition for the vapor compression refrigeration system. This full load condition also assumes a particular entering condenser water temperature for the water circulating through the coil within the subcooler. The refrigerant flow to the orifices or nozzles will however drop as the full load condition on the refrigeration system drops. This drop in refrigerant flow will reduce the ability of the orifice or nozzle to produce the pressure drop needed to flash the refrigerant vapor in the subcooler chamber. This reduces the amount of cooling of refrigerant that may be provided by the subcooler. This in turn affects the overall efficiency and operating range of the refrigeration system.

It is an object of this invention to provide the necessary pressure drop through an orifice or nozzle within a subcooler so as to introduce sufficient flashed refrigerant vapor into a subcooler under a variety of operating conditions.

SUMMARY OF THE INVENTION

The above and other objects of the invention are achieved by an electronically controlled flash subcooler system that automatically adjusts to varying amounts of refrigerant flow from the condenser. The flash subcooler system preferably includes a metering device in the form of a valve upstream of the orifices or nozzles. The variable metering device is adjusted by a microprocessor control, which receives temperature of water entering the condenser coil within the flash subcooler chamber as well as pressure from a pressure sensor within the flash subcooler. The temperature of the water entering the condenser coil is used to determine a desired pressure setpoint within the flash subcooler chamber. The sensed pressure from the pressure sensor within the subcooler is fed back to the microprocessor controller in order to determine if the pressure in the flash subcooler chamber is within a predefined range of the desired pressure setpoint. Any difference in the sensed pressure value with respect to the predefined range of pressure from the desired pressure setpoint is used by the controller to determine the magnitude and direction of change to the valve opening in the metering device.

BRIEF DESCRIPTION OF THE DRAWINGS

The invention and its objects and advantages will be better understood by reference to the accompanying drawings, in which.

DESCRIPTION OF THE PREFERRED EMBODIMENT

Figure 1:
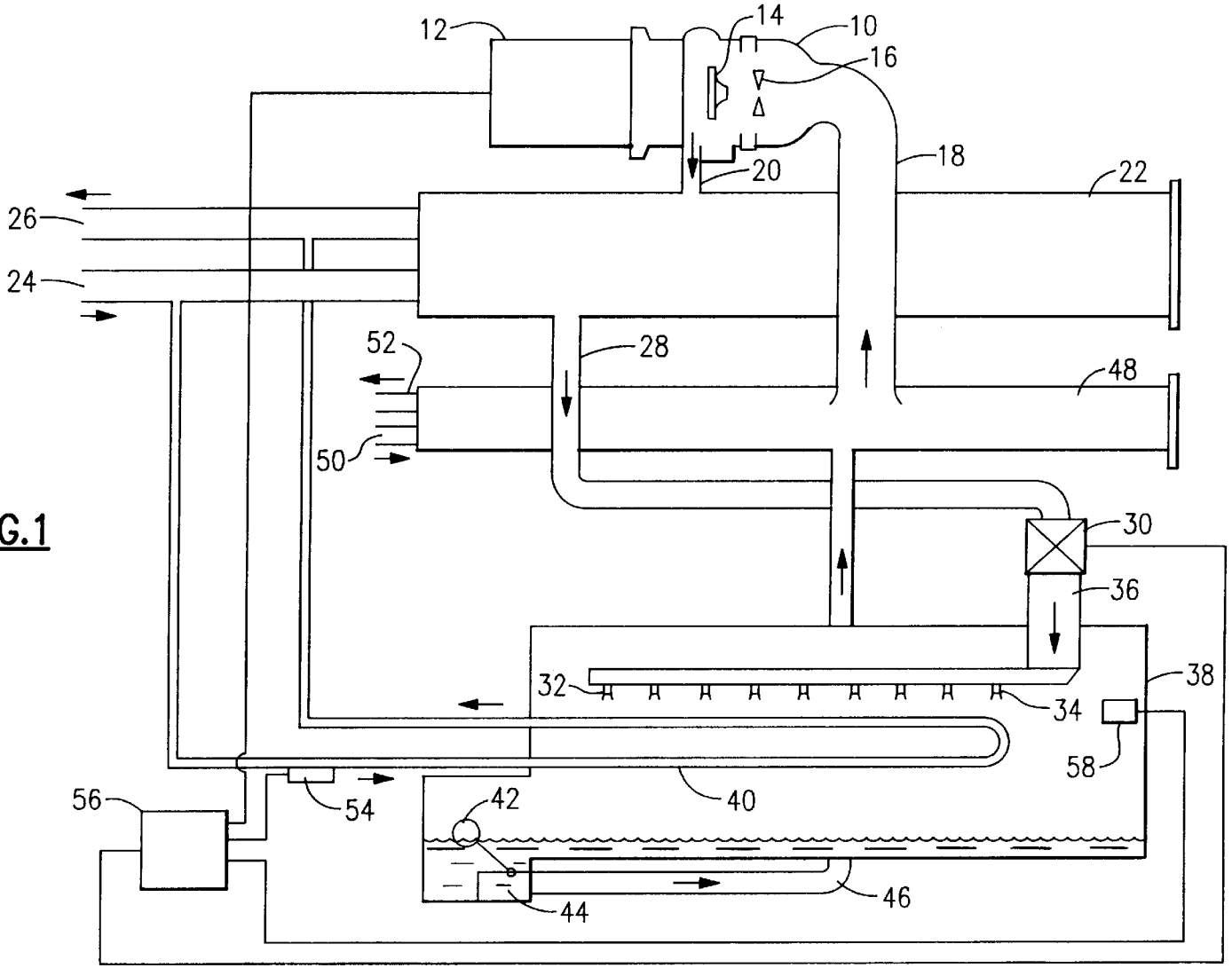
FIG. 1 illustrates a vapor compression refrigeration system having a subcooler therein wherein the subcooler has an associated control system for controlling a variable metering device associated with the subcooler.

Referring to FIG. 1, a vapor compression refrigeration system is seen to include a compressor 10 having a motor 12 and a single stage of compression indicated by an impeller 14. Vanes such as 16 control the amount of refrigerant entering the single stage of compression from an inlet 18. The compressed refrigerant exits the compressor 10 at an outlet 20 which is connected to the inlet side of a condenser 22. Water entering through an inlet 24 typically flows through a shell and tube-type heat exchanger (not shown) within the condenser 22 before exiting at an outlet 26. The gaseous refrigerant changes to a liquid refrigerant state as it flows over the shell and tube-type heat exchanger within the condenser 22. The condensed liquid refrigerant flows out of the condenser 22 through a conduit 28 to a flow metering device 30. The flow metering device 30 meters the rate of flow of the refrigerant from the condenser to a series of orifices such as 32 and 34 formed in a refrigerant flow pipe 36. The refrigerant exits from the flow pipe 36 through the orifices such as 32 and 34. The refrigerant partially flashes into a gaseous vapor after passing through the metering device 30 and then again when exiting the orifices 32 and 34. The liquid refrigerant collects in the bottom of a subcooler chamber 38. The subcooler chamber 38 is maintained at a pressure less than the saturation pressure of the sprayed refrigerant from the orifices 32 and 34 in a manner which will be explained hereinafter. This assures that a sufficient amount of the refrigerant exiting the orifices 32 and 34 will always change to a gaseous state. The gaseous refrigerant absorbs heat from the liquid refrigerant before being condensed by water circulating through a condenser coil 40 within the subcooler chamber 38. Liquid refrigerant is collected in the bottom of the subcooler chamber 38 until the liquid refrigerant rises to the level of a float 42, which opens an outlet 44 so as to allow liquid refrigerant to pass through a conduit 46 to an evaporator/cooler 48. Water enters the evaporator 48 via a water inlet 50 and preferably flows through a shell and tube type heat exchanger (not shown) within the evaporator 48 and exits through an outlet 52. The liquid refrigerant entering from the flash subcooler chamber 38 flows over the tubes in the shell and tube type heat exchanger and absorbs heat from the water circulating through the tubes. Chilled water exits the evaporator at the outlet 52. The resulting gaseous refrigerant is withdrawn from the evaporator 48 into the compressor 10 through the compressor inlet 18.

Referring to the condenser coil 40, it is to be noted that this coil receives water from the water inlet 24 to the condenser 22. It is to be appreciated that this is preferably water from a source such as a cooling tower or tap water source having a sufficiently low temperature to remove heat from the hot refrigerant in the condenser 22 or the flashed refrigerant in the subcooler chamber 38. It is furthermore to be appreciated that the water source for the condensing coil 40 need not necessarily be the same as the source for the condenser 22. In any event, a temperature sensor 54 is mounted to the inlet side of the condenser coil 40 so as to thereby sense the temperature of the water entering the subcooler chamber 38. The sensed temperature is noted by a controller 56, which preferably is a programmed microprocessor but could however be hardwired discrete logic. The controller 56 also receives a sensed pressure of the liquid refrigerant within the subcooler chamber from a pressure sensor 58. The controller 56 sends a control signal device to the flow metering 30 so as to preferably control a valve position of the flow metering device. The controlled valve position allows more or less refrigerant to flow to the flow pipe 36. It is to be appreciated that flow metering by the device 30 could be replaced by one or more variable orifices controlled by the controller 56.

Figure 2:
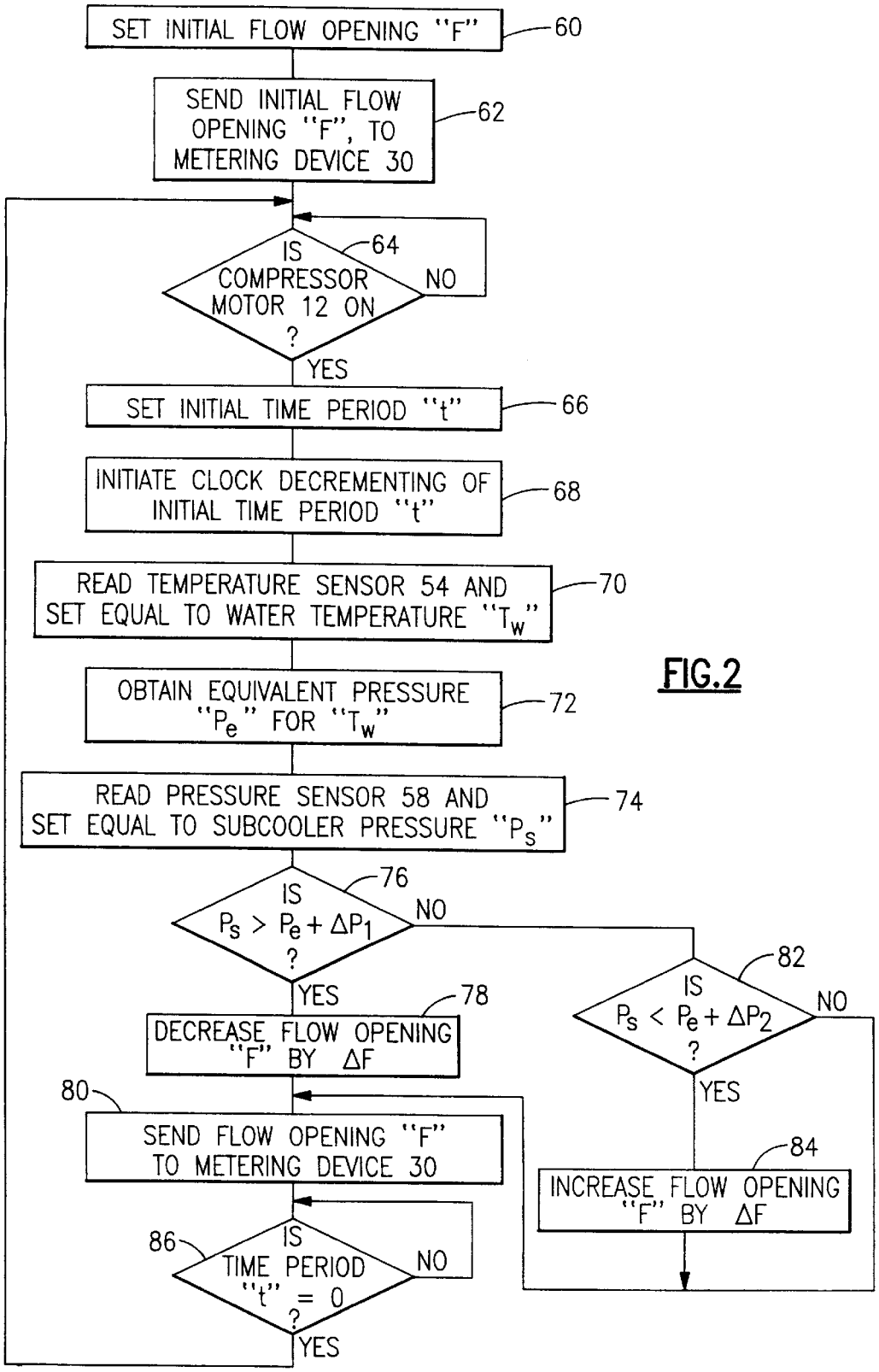
FIG. 2 illustrates a flow chart depicting a program resident within the controller of FIG. 1 for controlling the variable metering device of FIG. 1.

Referring to FIG. 2, the control process implemented by a microprocessor version of the controller 56 is seen to begin with step 60 wherein a value for the flow opening "F" of the metering device 30 is initially set. It is to be understood that this particular flow opening has been predetermined based on the full load design conditions for the refrigerant system of FIG. 1. This particular flow opening will normally produce the amount of refrigerant flow through the flow metering device 30 so as to cause the appropriate amount of vaporization of refrigerant through the orifices 32 and 34. This will in turn produce the amount of subcooling of the refrigerant within the subcooling chamber 38. The initial flow opening value "F" is sent to the flow metering device 30 in a step 62. The microprocessor controller 56 next proceeds to inquire as to whether the compressor motor 12 associated with the compressor 10 is on. This will normally be a known state within the controller 56 if it controls the motor 12. If it does not, then the controller 56 will simply receive a signal from the motor controller. The microprocessor controller simply awaits an indication that the motor 12 is on so as to cause refrigerant to flow within the system of FIG. 1. The microprocessor controller proceeds at this time to a step 66 and sets an initial time period of "t". The microprocessor controller will proceed to a step 68 and begin decrementing the initial time period "t". The microprocessor controller will next proceed to a step 70 and read the temperature sensor 54 and set the read value equal to a water temperature "$T_w$". It is to be appreciated that the temperature sensor 54 will be sensing the temperature of the incoming water to the subcooler chamber 38. The microprocessor controller will next proceed in a step 72 to obtain an equivalent saturated refrigerant pressure "$P_e$" that would cause the condensation of the flashed refrigerant in the subcooler chamber 38 to occur. This equivalent saturated refrigerant pressure "$P_e$" is preferably obtained by going to a table of equivalent saturated refrigerant pressures for specific refrigerant temperatures corresponding to $T_w$.

It is to be understood that there may not be a refrigerant temperature in the table precisely equal to $T_w$. In this case, a linear interpolation is performed using the closest refrigerant temperature and corresponding equivalent saturated refrigerant pressure to the temperature $T_w$. It is also to be understood that an equivalent saturated pressure "$P_e$" could be computed using a mathematical function which defines the relationship between equivalent saturated refrigerant pressure and inlet water temperature. In either case, an equivalent pressure "$P_e$" will be produced by the controller in step 72. The microprocessor controller proceeds in a step 74 to read pressure sensor 58 and set the read value equal to the subcooler pressure "$P_s$". The thus read pressure will reflect the pressure in the subcooler chamber 38 at a point underneath the orifices 32 and 34.

The microprocessor proceeds in a step 76 to inquire as to whether the subcooler pressure "$P_s$" is greater than the equivalent saturated refrigerant pressure "$P_e$" plus an incremental pressure value of "$\Delta P_1$". The value of "$\Delta P_1$" is chosen so as to ensure that all flash gas leaving the orifices 32 and 34 is condensed in the subcooler chamber. This "$\Delta P_1$" value is preferably a differential pressure slightly above the equivalent saturated refrigerant pressure, "$P_e$" The value of "$\Delta P_1$" used in step 76 is preferably determined by adding a small incremental amount of temperature to the water temperature, "$T_w$" and finding the equivalent saturated refrigerant pressure, "$P_e^1$" for this elevated temperature in the stored table of data used in step 72. This elevated temperature could for example be three to four degrees Fahrenheit above the water temperature "$T_w$". Alternatively, the equivalent saturated refrigerant pressure, "$P_e^1$" could be obtained by an algorithmic calculation. The value of "$\Delta P_1$" would be the difference between "$P_e^1$" and "$P_e$".

The microprocessor controller will proceed to a step 78 in the event that the subcooler pressure "$P_s$" is greater than "$P_e$" plus "$\Delta P_1$". The microprocessor will decrease the flow opening, "F", by an amount "$\Delta F$" in step 78. It is to be understood that "$\Delta F$" may be either a small predefined amount of commanded flow opening or "$\Delta F$" can be computed as a function of the error between the desired pressure "$P_e$" plus "$\Delta P_1$" and the actual pressure "$P_s$". "$\Delta F$" is preferably the small predefined amount of commanded flow opening if the time "t" between successive executions of the logic of FIG. 2 is set low. The computation of "$\Delta F$" would be more appropriate if the time between successive executions of the logic of FIG. 2 was such as to impact the condensing of the flashed refrigerant in the subcooler chamber. In either case, the resulting flow opening value determined in step 78 is sent to the flow metering device 30 in a step 80.

The flow metering device 30 preferably includes a local device control system which will respond to commanded flow opening "F". This local control will compare the commanded flow opening with a minimum flow opening position for the particular flow metering device. The commanded flow opening will be implemented to the extent that it exceeds the minimum flow opening position. It is to be appreciated that the above logic could also be included in the microprocessor within the controller 56.

Referring again to step 76, in the event that the microprocessor controller determines that "$P_s$" is not greater than the equivalent saturated refrigerant pressure "$P_e$" plus the differential pressure value "$\Delta P_1$", then the microprocessor controller will proceed to a step 82 and inquire as to whether the sensed pressure "$P_s$" is less than the equivalent saturated refrigerant pressure "$P_e$" plus a differential pressure value of "$\Delta P_2$". The differential pressure value "$\Delta P_2$" is preferably a differential pressure value that will prevent excessive modulation of the metering device 30. In other words, no repositioning of the flow opening "F" will occur if the sensed subcooler pressure "$P_s$" is within a range of pressure values defined by the difference between "$\Delta P_1$" and "$\Delta P_2$". The value of "$\Delta P_2$ may vary anywhere from zero to one hundred percent of the value of "$\Delta P_1$" so as to thereby allow for less or more modulation of the flow metering device 30. Referring again to step 82, in the event that the subcooler pressure "$P_s$" is less than the equivalent pressure plus the differential pressure "$\Delta P_2$", then the microprocessor controller will proceed to a step 84 and increase the flow opening, "F" by the amount "ΔF". The amount "ΔF" would be computed or defined in the same manner as previously discussed with respect to step 78. The processor will proceed from step 84 to step 80 wherein the new flow opening value "F" is sent to the metering device 30.

As has been previously discussed, the flow metering device 30 preferably includes a local device control system which will respond to commanded flow opening "F". This local control will compare the increased commanded flow opening with a maximum flow opening position for the particular flow metering device. The commanded flow opening will be implemented to the extent that it is less than the maximum flow opening position. It is to be appreciated that the above local control logic could also be included in the logic of FIG. 2 if necessary.

Referring again to step 82, as has been previously discussed, if the sensed pressure value is not less than the equivalent pressure plus the differential pressure "$\Delta P_2$", then no change in the flow opening "F" is computed and tile microprocessor simply maintains the same flow opening commanded value for the metering device 30 in step 80. The microprocessor controller proceeds out of step 80 to a step 86 and inquires as to whether the initial time period "t" has expired. When this time period has expired, the microprocessor controller will again cycle back to step 64 and inquire as to whether the compressor motor 12 is on. In the event that the compressor motor 12 is off, the microprocessor controller will again proceed through steps 66–84 to determine whether or not further adjustment in the flow opening of the metering device 30 is necessary. This will continue to occur until such time as the compressor motor 12 is turned off. At such time, the microprocessor controller will simply await the next indication that the compressor motor has been turned on whereupon the steps 66–86 will again take place. It is to be appreciated that a method and apparatus has been disclosed for optimally controlling the flow of refrigerant through the flow metering device 30 so as to thereby produce the required pressure drop in the refrigerant exiting the orifices 32 and 34.

It is also to be appreciated that the control process, as implemented by the microprocessor controller 56, could be implemented in hard wired logic. In such a case, the various portions of logic would appear as discrete elements. It is to be furthermore appreciated that the flow metering device 30 and the orifice pipe 36 and orifices 32 and 34 could be replaced by an alternative means for spraying liquid refrigerant into the subcooler chamber 38. For example, the flow metering device 30 might be replaced by one or more variable orifices, which would each have an opening that could be varied by an prescribed amount which would be computed and commanded in accordance with the logical steps described for the microprocessor controller 56 or in hard wired logic.

It will be appreciated by those skilled in the art that further changes could be made to the above described invention without departing from the scope of the invention. Accordingly, the foregoing description is by way of example only and the invention is to be limited only by the following claims and equivalents thereto.

What is claimed is:

1. A system for a subcooling refrigerant within a vapor-compression refrigeration system, said subcooling comprising:

a subcooling chamber;

at least one orifice for emitting hot refrigerant into said subcooling chamber;

a flow metering device for defining the flow of refrigerant to said orifice;

a controller connected to said flow metering device, said controller being operative to control the opening in said flow metering device so as to thereby control the flow rate of refrigerant to said orifice and to thereby control the pressure at which the refrigerant is emitted into said subcooling chamber.

2. The system of claim 1 wherein the subcooling system further comprises:

a condensing heat exchanger located within said cooling chamber;

a temperature sensor mounted to the inlet side of said condensing heat exchanger so as to sense the temperature of the fluid entering the condensing heat exchanger; and wherein said controller is operative to read the sensed temperature of the fluid entering the condensing heat exchanger and to thereafter define a pressure setpoint temperature for the liquid refrigerant in the subcooling chamber.

3. The subcooling system of claim 2 further comprising:

a pressure sensor mounted within said subcooling chamber so as to sense the pressure of the liquid refrigerant in the subcooling chamber; and wherein said controller is operative to read the sensed pressure of the refrigerant within the subcooling chamber and compare the sensed pressure with the pressure setpoint temperature for the liquid refrigerant in the subcooling chamber.

4. The subcooling system of claim 3 wherein said controller is operative to define a differential pressure above the pressure setpoint that is to be used in the comparison of the sensed pressure with the pressure setpoint temperature for the liquid refrigerant in the subcooling chamber.

5. The subcooling system of claim 4 wherein said controller is operative to decrease a commanded flow opening in the flow metering device when the sensed pressure is greater than the sum of the pressure setpoint and the differential pressure above the setpoint pressure.

6. The subcooling system of claim 5 wherein said controller is operative to further compare the sensed pressure with the setpoint pressure plus a second differential pressure above setpoint pressure in the event the sensed pressure is below the sum of the setpoint temperature plus the first differential pressure.

7. The subcooling system of claim 6 wherein said controller is operative to increase a commanded flow opening of the flow metering device when the sensed pressure is less than the sum of the setpoint pressure plus the second differential pressure above setpoint pressure.

8. A refrigeration system having a condenser which condenses refrigerant vapor to a liquid at varying pressures and temperatures depending on the load conditions or the refrigeration system and having an evaporator which operates at lower pressure and temperatures so as to evaporator liquid refrigerant to a vapor, and furthermore having a refrigerant subcooling unit located between said condenser and said evaporator unit, said subcooling unit comprising:

a subcooling chamber;

at least one device for emitting hot liquid refrigerant from the condenser to the subcooling chamber; and a controller connected to said device for emitting hot liquid refrigerant, said controller being operative to control the flow rate of refrigerant emitted by said device for emitting hot liquid refrigerant so as to thereby control the pressure at which the hot liquid refrigerant is being emitted into said subcooling chambered.

9. The refrigeration of claim 8 wherein the subcooling unit further comprises:

a condensing heat exchanger located within said cooling chamber;

a temperature sensor mounted to the inlet side of said condensing heat exchanger so as to sense the temperature of the fluid entering the condensing heat exchanger; and wherein said controller is operative to read the sensed temperature of the fluid entering the condensing heat exchanger and to thereafter define a pressure setpoint temperature for the liquid refrigerant in the subcooling chamber.

10. The subcooling unit of claim 9 further comprising:

a pressure sensor mounted within said subcooling chamber so as to sense the pressure of the liquid refrigerant in the subcooling chamber; and wherein said controller is operative to re ad the sensed pressure of the liquid refrigerant within the subcooling chamber and compare the sensed pressure with the pressure setpoint temperature for the liquid refrigerant in the subcooling chamber.

11. The subcooling unit of claim 10 wherein said controller is operative to define a differential pressure above the pressure setpoint that is to be used in the comparison of the sensed pressure with the pressure setpoint temperature for the liquid refrigerant in the subcooling chamber.

12. The subcooling unit of claim 11 wherein said controller is operative to decrease a commanded flow rate of refrigerant emitted by said device for emitting hot liquid refrigerant when the sensed pressure is greater than the sum of the pressure setpoint and the differential pressure above the setpoint pressure.

13. The subcooling unit of claim 12 wherein said controller is operative to further compare the sensed pressure with the setpoint pressure plus a second differential pressure above setpoint pressure in the event the sensed pressure is below the sum of the setpoint temperature plus the first differential pressure.

14. The subcooling unit of claim 13 wherein said controller is operative to increase a commanded rate of flow of the device for emitting hot liquid refrigerant when the sensed pressure is less than the sum of the setpoint pressure plus the second differential pressure above setpoint pressure.

* * * * *